United States Patent [19]

Hillström et al.

[11] Patent Number: 5,034,128

[45] Date of Patent: Jul. 23, 1991

[54] APPARATUS FOR DEWATERING PULP

[75] Inventors: Rune Hillström; Finn Jacobsen, both of Karlstad, Sweden; Joseph R. Phillips, Glens Falls, N.Y.

[73] Assignee: Kamyr Aktiebolag, Karlstad, Sweden

[21] Appl. No.: 541,510

[22] Filed: Jun. 21, 1990

[30] Foreign Application Priority Data

Jun. 29, 1989 [SE] Sweden ..... 8902349-3

[51] Int. Cl.[5] ..... B01D 25/38

[52] U.S. Cl. ..... 210/411; 210/108; 210/413; 210/414; 210/415; 210/427; 162/56

[58] Field of Search ..... 162/56, 57; 210/108, 210/413, 414, 415, 411, 427

[56] References Cited

U.S. PATENT DOCUMENTS

| | | | |
|---|---|---|---|
| 3,221,886 | 12/1965 | Lamort | 210/415 |
| 3,367,506 | 2/1968 | Rosaen | 210/415 |
| 3,784,016 | 1/1974 | Akiyama | 210/415 |
| 3,962,962 | 9/1975 | Reinhall | 210/413 |
| 4,188,286 | 2/1980 | Holz | 210/415 |
| 4,337,158 | 6/1982 | Bodine | 210/413 |
| 4,464,253 | 8/1984 | Kuri | 210/413 |
| 4,705,055 | 11/1987 | Rohm et al. | 210/413 |
| 4,818,402 | 4/1989 | Steiner et al. | 210/413 |
| 4,931,180 | 6/1990 | Darchambeau | 210/415 |

FOREIGN PATENT DOCUMENTS

| | | |
|---|---|---|
| 957287 | 11/1974 | Canada . |
| 117717 | 11/1946 | Sweden . |
| 186644 | 12/1963 | Sweden . |
| 392833 | 4/1977 | Sweden . |

*Primary Examiner*—Stanley Silverman
*Assistant Examiner*—Neil M. McCarthy
*Attorney, Agent, or Firm*—Cushman, Darby & Cushman

[57] ABSTRACT

An apparatus for dewatering a pulp is described, comprising a vessel having a pulp chamber for pulp to be dewatered; a pulp inlet to the vessle; pulp outlet from the vessel; a filtrate chamber with an outlet for filtrate expelled from the pulp; a stationary cylindrical screen mounted within the vessel and defining said plup chamber and filtrate chamber on opposite sides thereof; and mechanical cleaning means supported by a shaft and disposed in the pulp chamber close to the screen face of the screen for removing a mat of pulp therefrom. The apparatus further comprises a backflushing means mounted outside the vessel and including a cylinder with first and second end portions and a piston mounted within the cylinder for reciprocal movement therein. The first end portion communicates with the interior of the apparatus, and the second end portion communicates with the filtrate chamber. Furthermore, the backflushing means comprises a power transmitting means for actuating the piston in the cylinder to move reciprocally in cycles each cycle comprising a slow stroke for drawing filtrate slowly into the cylinder and removing pulp slowly therefrom, and a fast stroke for expelling said drawn-in filtrate quickly out from the cylinder and drawing pulp quickly into the cylinder, said quickly expelled filtrate causing a backlfush through the screen.

9 Claims, 2 Drawing Sheets

APPARATUS FOR DEWATERING PULP

FIELD AND BACKGROUND OF THE INVENTION

The present invention relates to an apparatus for dewatering a pulp.

Apparatus for dewatering pulp are known through a number of patent specifications, see, e.g. SE 117 717, SE 186 644, SE 392 838 and CA 957 287. One drawback with such apparatus is the fact that the mechanical cleaning means is insufficient to keep the stationary screen clean so that the screen is clogged by fiber material, the efficiency of the screen being gradually reduced.

SUMMARY OF THE INVENTION

The object of the present invention is to reduce the above mentioned drawback and provide an apparatus which not only clean the screen mechanically but also hydraulically by means of an exterior back-flushing device without causing undesired pressure variations within the apparatus.

The invention relates to an apparatus for dewatering a pulp, comprising a vessel having at least one pulp chamber for pulp to be dewatered; a pulp inlet to the vessel; a pulp outlet from the vessel; at least one filtrate chamber for filtrate expelled from the pulp; at least one stationary cylindrical screen rigidly mounted within the vessel and defining said pulp chamber and filtrate chamber on opposite sides thereof; mechanical cleaning means supported by a shaft and disposed in said pulp chamber close to the screen face of the screen for removing a thickened mat of pulp therefrom by rotating the cleaning means by means of said shaft; and a filtrate outlet from said filtrate chamber, said apparatus further comprising a back-flushing means mounted outside the vessel and including at least one cylinder having first and second end portions and a piston mounted within said cylinder for reciprocal movement therein, said first end portion of the cylinder being in open communication with the interior volume of the apparatus, and said second end portion of the cylinder being in open communication with the filtrate chamber, and said back-flushing means comprising a power transmitting means for actuating the piston in the cylinder to move reciprocally in cycles each of said cycles comprising a slow stroke for drawing filtrate slowly into said cylinder and removing pulp slowly therefrom, and a fast stroke for expelling said drawn-in filtrate quickly out from said cylinder and drawing pulp quickly into the cylinder, said quickly expelled filtrate causing a backflush through said screen.

It is preferred that said first end portion of the cylinder is in open communication with the interior volume of the pulp inlet. It is also suitable that said first end portion of the cylinder is connected directly to a conduit or closure defining the inlet at the upstream end of the vessel.

BRIEF DESCRIPTION OF THE DRAWINGS

The invention will be described further in the following with reference to the accompanying drawings.

DESCRIPTION OF ILLUSTRATED EMBODIMENTS

Figure 1:
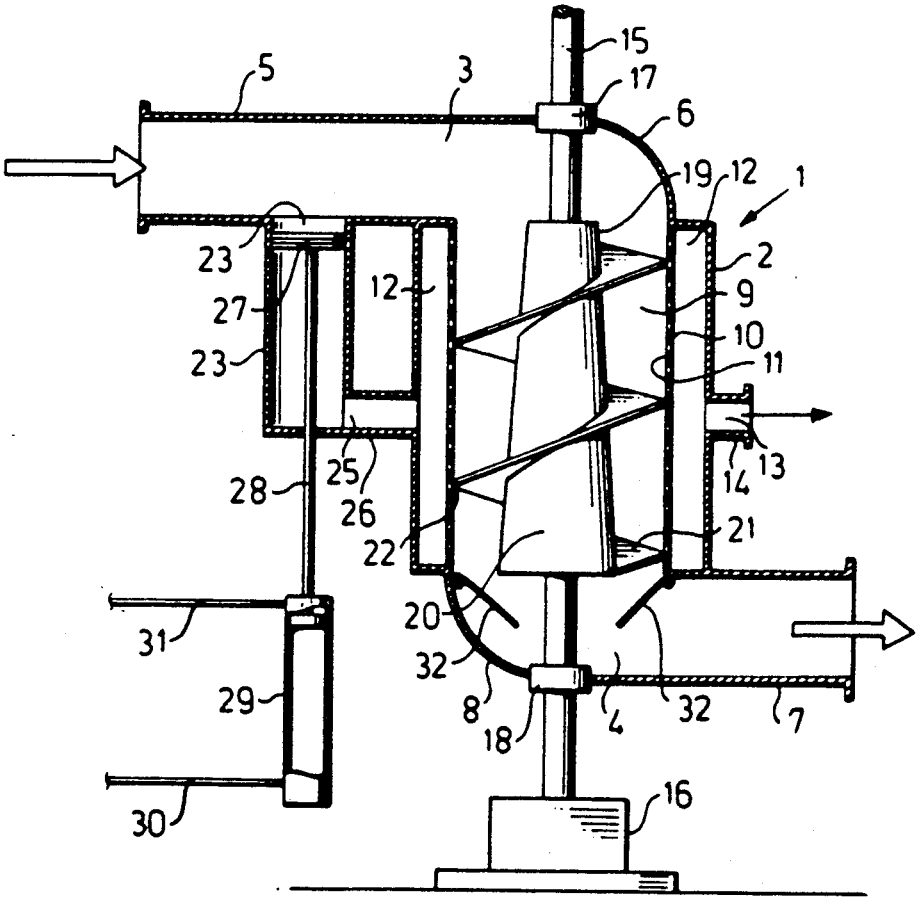
FIG. 1 is a side view of an apparatus according to a first embodiment.

FIG. 1 illustrates an apparatus which is of the screw press type and comprises a generally upright vessel 1 having an outer cylindrical casing 2, an inlet 3 for pulp to be dewatered, and an outlet 4 for dewatered pulp. The inlet 3 comprises a conduit 5 and a closure 6 at the top of the vessel. The outlet 4 comprises a conduit 7 and a closure 8 at the bottom of the vessel. Thus, the pulp inlet 3 and the pulp outlet 4 are vertically spaced from each other. The pulp to be dewatered is introduced into the pulp inlet 3 at the top of the vessel and is fed downwardly within a pulp chamber 9 of the vessel 1 extending between the pulp inlet 3 and pulp outlet 4, the pulp thus dewatered being discharged through the outlet 4 adjacent the bottom of the vessel 1.

Within the vessel there is a screening means in the form of a stationary cylindrical screen 10 rigidly mounted to the opposite end closures 6, 8. Thus, the cylindrical screen 10 defines and surrounds said pulp chamber 9, said screen 10 having a cylindrical screen face 11 which is generally vertical and is in contact with the pulp within the pulp chamber 9. Further, the cylindrical screen 10 is spaced from the outer casing 2 so that an annular filtrate chamber 12 is defined therebetween, the opposite ends of the filtrate chamber 12 being closed by the peripheral portions of the closures 6, 8. The casing 2 of the vessel 1 is provided with an outlet 13 comprising a conduit 14 for discharging the filtrate from the filtrate chamber 12.

Furthermore, the apparatus includes a shaft 15 which is driven by a motor 16 and extends vertically through the vessel 1 and opposite end closures 8, 6. The shaft 15 is sealed and rotatably journalled at the opposite end closures 6, 8 by means of suitable sealing and bearing units 17, 18. The shaft 15 supports a mechanical cleaning means for rotation together with the shaft 15 as a unit. The cleaning means comprises a screw 19 with a core 20 and a screw blade 21 surrounding the core 20, the peripherical helical surface 22 of the screw blade 21 being positioned close to the screen face 11 with a small clearance therebetween to avoid frictional engagement. When the shaft 15 is rotating the screw blade 21 will remove the thickened layer or mat of pulp which is formed continuously on and adjacent the screen face 11 so that the screen face 11 is cleaned repeatedly as the screw blade 21 is rotating. The screw blade 21 also feeds the thickened pulp to the outlet 4. In the embodiment illustrated in FIG. 1 the core 20 is formed as a frustum of a cone, the base of which being positioned adjacent the outlet 4 so that the cross-sectional area of the pulp chamber 9 will decrease in the direction to the outlet 4. In this way the screw 19 also may function as a pressing means due to the decreasing volume of the pulp chamber 9 in the direction of feeding so that an increased super atmospheric pressure will be created therein forcing a portion of the liquid phase of the pulp suspension through the screen holes and into the filtrate chamber 12, in which atmospheric pressure or a vacuum is prevailing. In alternative embodiments the core 20 may be cylindrical whereas the screen 10 may be cylindrical, as shown, or it may have the form of a frustum of a cone.

In accordance with the present invention the apparatus comprises an exterior backflushing means which in the preferred embodiment illustrated in FIG. 1 comprises a simple cylinder 23 which is open at both end portions thereof and extends outside the vessel 1 generally parallel to the shaft 15. The first open end portion 24 of the cylinder 23 is in open communication with the interior of the pulp inlet 3, and the second open end portion 25 is in open communication with the filtrate chamber 12 within the vessel 1. The open communications are provided in that the first end portion 24 of the cylinder 23 is mounted directly on the inlet conduit 5 and the second end portion 25 is connected to the filtrate chamber 12 through a short conduit 26. Mounted within the cylinder 23 for relative reciprocation with respect to the cylinder 23 is a piston 27, which is connected to a piston rod 28. The piston rod 28 is connected to a power transmitting device in the form of a hydraulic or pneumatic cylinder 29, which effects movement of the piston 27 with respect to the cylinder 23 in a predetermined design of reciprocal movement comprising repeated cycles each including a slow stroke for drawing filtrate into the cylinder 23 and a fast stroke for quickly expelling the filtrate therefrom and effecting a backflushing of the screen. A short or long resting period of time may be included between two subsequent cycles as desired in dependence on the clogging condition or screening efficiency of the screen. The reciprocation may be performed automatically at predetermined intervals of time in response to control means including timer means, or may be performed automatically upon detection that the extent of clogging is in excess of a predetermined amount, for example by observing a pressure drop across the screen face 11 of the screen 10 so that when the differential pressure exceeds a predetermined value the piston 27 is reciprocated one or more times. The hydraulic or pneumatic cylinder 29 is of the double acting type and comprises conduits 30, 31 connected to the opposite end portions of the cylinder 29 for supplying and discharging pressure medium. Thus, in operation the piston 27 is moved slowly in the direction to the inlet conduit 5 while filtrate is drawn into the cylinder 23 through the second open end portion 25 from the filtrate chamber 12 via the short conduit 26. In this way the piston 27 is moved to an upper starting position close to the inlet conduit 5. In this starting position the piston 27 may rest a predetermined period of time or it may be actuated directly as mentioned above. In the second part of the cycle the cylinder 29 is actuated to quickly move the piston 27 downwardly with respect to cylinder 23 so that the filtrate in the cylinder 23 is returned in the direction to the filtrate chamber 12 at a high speed creating an increase of pressure in the filtrate chamber 12. By means of this temporary increase of pressure the holes will be efficiently cleaned from clogged material. During this fast stroke of the piston 27 pulp is drawn into the cylinder 23 from the inlet conduit 5. Since the volume of drawn-in pulp into the cylinder 23 corresponds to the entire volume of backflushing filtrate forced through the screen 10 into the pulp chamber 9 and since the inlet conduit 5 is in open communication with the pulp chamber 9 of the vessel 1 the pressure increase in the pulp chamber 9 and variations of the flow of pulp in the outlet conduit 7 will be reduced to a minimum. In order to obtain a quick short pressure increase in the filtrate chamber 12 it is preferred to mount a flow-controlled valve (not shown) in the filtrate conduit 14. An adjustable means for creating an increased pressure in the apparatus may be used as desired. An elevated piping or discharge may be connected to the apparatus in order to provide sufficient back pressure. For most of the consistency range a discharge valve may also be utilized for this purpose. The embodiment according to FIG. 1 includes an adjustable mechanical device for creating an increased pressure in the apparatus so that a sufficiently high pressure difference will be established between the pulp chamber 9 and filtrate chamber 12. The adjustable mechanical device is in the form of two pivotable shutters 32 by means of which the area of flowing through the pulp outlet 4 can be decreased or increased in an adjustable manner as desired.

The apparatus described is mounted in a pulp processing system. Normally the pressure for effecting the dewatering of pulp is created by a pump. Thus, the pulp may be fed to the apparatus by means of a pump (not shown) that operates at any desired pressure head so that a pressure difference is established between the pulp chamber 9 and filtrate chamber 12 effecting a flow of liquid, i.e. filtrate, through the screen 10, which is provided with suitable through holes. The flow of filtrate may be increased further by maintaining a vacuum in the filtrate chamber and/or using a screw press function such as that described above.

Alternatively the apparatus shown in FIG. 1 may be inverted. The vessel may also be disposed horizontally.

Figure 2:
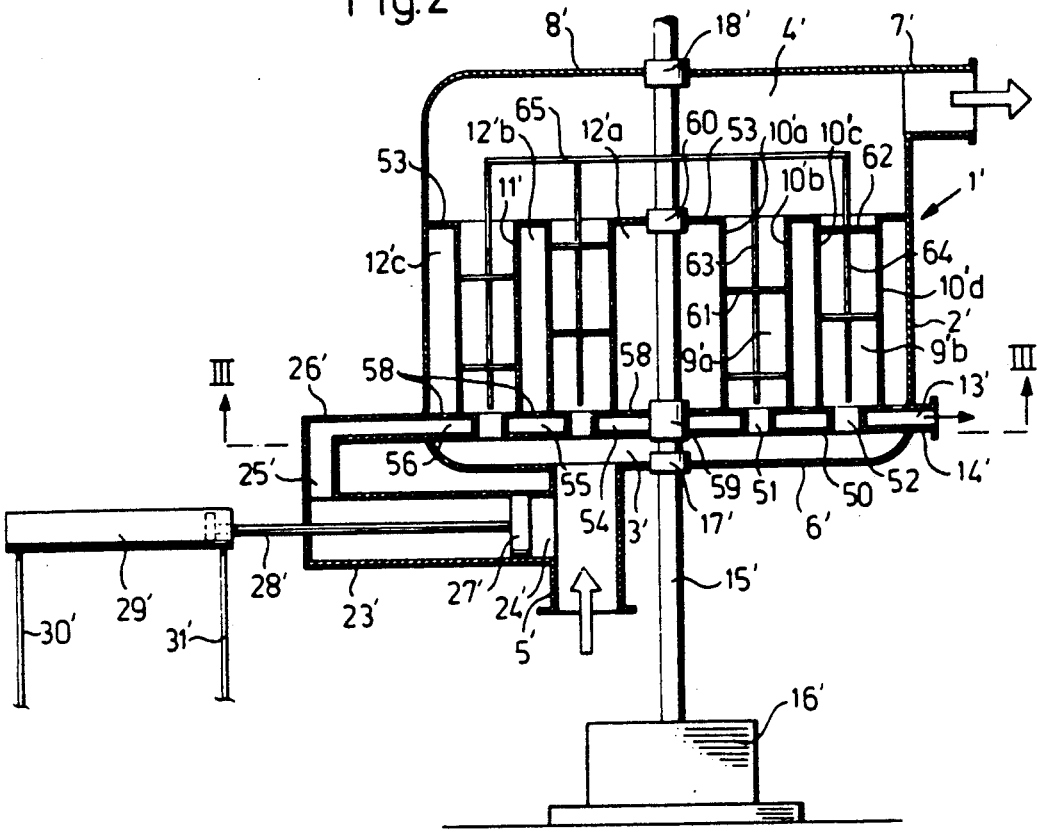
FIG. 2 is a side view of an apparatus according to a second embodiment.
Figure 3:
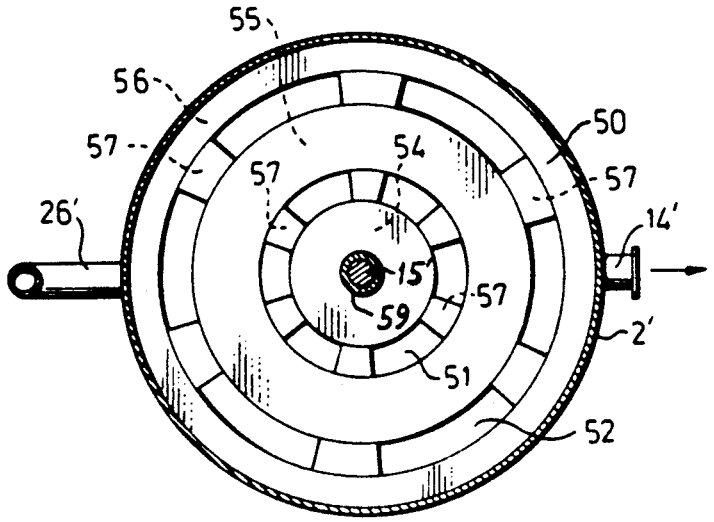
FIG. 3 is a cross-sectional view according to line III—III in FIG. 2.

A further embodiment of the invention is illustrated in FIGS. 2 and 3. The component parts of the structure illustrated in FIGS. 2 and 3 that are generally equivalent or comparable to those in the embodiment according to FIG. 1 are illustrated by the same reference numerals only added by a prime sign (').

The apparatus illustrated in FIGS. 2 and 3 comprises a generally upright vessel 1' having an outer cylindrical casing 2', an inlet 3' for pulp to be dewatered, and an outlet 4' for dewatered pulp. The inlet comprises a conduit 5' and a closure 6' at the bottom of the vessel. The outlet 4' comprises a conduit 7' and a closure 8' at the top of the vessel. Thus, the pulp inlet 3' and the pulp outlet 4' are vertically spaced from each other. The pulp to be dewatered is introduced into the pulp inlet 3' at the bottom of the vessel and is fed upwardly within two concentric pulp chambers 9'a, 9'b of the vessel extending between the pulp inlet and pulp outlet, the pulp thus dewatered being discharged through the outlet 4' adjacent the top of the vessel.

Within the vessel 1' there is a screening means in the form of a plurality of stationary cylindrical concentric screens 10'a, 10'b, 10'c, 10'd rigidly mounted to the top surface of a horizontal support element 50 which is spaced from the inlet closure 6' of the vessel as is shown in FIG. 3. The support element 50 is rigidly mounted to the casing 2' and is provided with a plurality of inner and outer arc-shaped inlet gaps 51 and 52, respectively, said gaps being positioned along concentric circles. Through the gaps 51, 52 the inlet 3' is in open communication with the concentric pulp chambers 9'a, 9'b. In the embodiment illustrated in FIG. 2 the screening means consists of four stationary cylindrical concentric screens, viz. a central screen 10'a, a first intermediate screen 10'b, a second intermediate screen 10'c, and an outer screen 10'd each of which having a cylindrical screen face 11' which is generally vertical and is in contact with the pulp within the pulp chamber 9'a, 9'b. Said outer screen 10'd is spaced from the outer casing 2' so that an annular outer filtrate chamber 12'c is defined therebetween. The first and second intermediate screens 10'b, 10'c are spaced from each other so that an annular intermediate filtrate chamber 12'b is defined therebetween. The central screen 10'a encloses a central filtrate chamber 12'a. Each filtrate chamber 12' is closed at the top by a horizontal plate 53. The filtrate chambers are in open communication with a filtrate outlet 13' for discharging filtrate therefrom and comprising a conduit 14' connected to the support element 50 and three annular channels 54, 55, 56, a plurality of radial channels 57 connecting the annular channels with each other, and a plurality of arc-shaped gaps 58 which are disposed in the top of the support element 50 to provide open communications between each filtrate chamber 12'a, 12'b, 12'c and opposite annular channel 54, 55, 56 axially aligned therewith. In order to effect the flow of liquid through the screens 10', which are provided with suitable through holes, a pressure difference is established between the pulp chambers 9' and filtrate chambers 12' as described above.

Furthermore, the apparatus illustrated in FIGS. 2 and 3 includes a shaft 15' which is driven by a motor 16' and extends vertically through the vessel and opposite closures 6', 8'. The shaft 15 is sealed and rotatably journalled at the opposite end closures 6', 8', at the support element 50, and at the central plate 53 by means of suitable sealing and bearing units 17', 18', 59, 60. The shaft 15' supports a mechanical cleaning means for rotating together with the shaft 15' as a unit. The cleaning means comprises a cleaning element 61, 62 for each pulp chamber 9'a, 9'b, a vertical carrying member 63, 64 for each cleaning element 61, 62 and a horizontal carrying member 65 for carrying said two vertical carrying members 63, 64. The horizontal carrying member 65 may consist of a disc or a plurality of radial arms, or a combination of such arms and at least one ring. The vertical carrying members 63, 64 preferably consist of a plurality of vertical arms to which the cleaning elements 61, 62 are attached. Instead of vertical arms a cylinder may be used in each pulp chamber. Each cleaning element 61, 62 consists of a helical blade which is perpendicular to the opposite screens 10'. The free edge surfaces of the helical blades 61, 62 are positioned close to the screen faces 11' with a small clearance therebetween to avoid frictional engagement. When the shaft 15' is rotating the helical blades 61, 62 will remove the thickened layer or mat of pulp which is formed continuously on and adjacent the screen faces 11' so that the screen faces 11' are cleaned repeatedly as the helical blades 61, 62 are rotating by the shaft 15'. The helical blades 61, 62 also feed the thickened pulp upwardly to the outlet 4'.

In accordance with the present invention the apparatus illustrated in FIGS. 2 and 3 comprises an exterior backflushing means mainly designed and disposed as that according to FIG. 1. Thus, the back-flushing means comprises a simple cylinder 23' which is open at both end portions thereof and extends outside the vessel 1' generally perpendicular to the shaft 15'. The first open end portion 24' of the cylinder 23' is in open communication with the interior of the pulp inlet 3', and the second open end portion 25' is in open communication with the filtrate chambers 12'a, 12'b within the vessel. The open communications are provided in that the first end portion 24' of the cylinder 23' is mounted directly on the inlet conduit 5' and the second end portion 25' is connected to the outlet channel system through a short conduit 26' attached to the horizontal support element 50. Mounted within the cylinder 23' for relative reciprocation with respect to the cylinder 23' is a piston 27', which is connected to a piston rod 28'. The piston rod 28' is connected to a power transmitting device in the form of a hydraulic or pneumatic cylinder 29', which effects movement of the piston 27' with respect to the cylinder 23' in a predetermined design of reciprocal movement as described above for the embodiment illustrated in FIG. 1. The hydraulic or pneumatic cylinder 29' is double acting and comprises for supplying and discharging pressure medium. Thus, in operation the piston 27' is moved in the direction to the inlet conduit 5' in a slow stroke of the cycle while filtrate is drawn into the cylinder 23' through the second open end 25' from the outlet channel system 54–58 and filtrate chambers 12'a, 12'b, 12'c via the conduit 26'. In this way the piston 27' is moved to an upper starting position close to the inlet conduit 5'. In this starting position the piston 27' may rest a predetermined period of time or it may be actuated directly as mentioned above. In the second part of the cycle the cylinder 29' is actuated to move the piston 27' with respect to cylinder 23' in a fast stroke so that the filtrate in the cylinder 23' is returned in the direction to the outlet channel system 54–58 and filtrate chambers 12'a, 12'b, 12'c at a high speed creating an increase of pressure in the filtrate chambers. By means of this temporary increase of pressure the holes will be efficiently cleaned from clogged material. During this fast stroke of the piston 27' pulp is drawn into the cylinder 23' from the inlet conduit 5'. Since the volume of drawn-in pulp into the cylinder 23' corresponds to the entire volume of backflushing filtrate forced through the screens into the pulp chambers and since the inlet conduit 5' is in open communication with the pulp chambers 9'a, 9'b of the vessel the pressure increase in the pulp chamber and variations of the flow of pulp in the outlet conduit 7' will be reduced to a minimum. In order to obtain a quick short pressure increase in the filtrate chambers 12'a, 12'b, 12'c it is preferred to mount a flow-controlled valve (not shown) in the filtrate conduit 14'.

The shaft 15' may be provided with a screw such as that shown in FIG. 1, the screw blade of which cooperating with the cylindrical screen face 11' of the inner screen 10'a.

The power transmitting device may also consist of a mechanical arrangement, such as a motor.

The conduit between the second end portion and the filtrate chamber may alternatively include two or more throttled branches which are connected to the filtrate chamber spaced from each other for more effective distribution of the filtrate from the backflushing cylinder during said fast stroke to circumferentially different interior volumes of the filtrate chamber.

The apparatus according to the invention is particularly useful as a thickener for dewatering a pulp suspension of low consistency, e.g. 0,5 to 5%, based on dry fiber, to obtain a thickened pulp suspension of a consistency in the range of about 5 to 30% or even higher. For other applications the apparatus is useful for thickening a pulp suspension from 8 to 10% up to 13 to 16%.

It is highly preferred that the end portion 24 of the cylinder is in open communication with the interior volume of the pulp inlet 3. When it is connected to the pulp outlet 4 it may be some undesired effects, such as formation of channels in the thickened pulp, in particularly when the thickened pulp has a high consistency of fiber. However, it is yet possible to utilize the invention at the outlet side of the apparatus, in particular when the thickened pulp has a consistency in the lower portion of the above-mentioned range.

That which is claimed is:

1. An apparatus for dewatering a pulp, comprising a vessel having at least one pulp chamber for pulp to be dewatered; a pulp inlet to the vessel; a pulp outlet from the vessel; at least one filtrate chamber for filtrate expelled from the pulp; at least one stationary cylindrical screen rigidly mounted within the vessel and defining said pulp chamber and filtrate chamber on opposite sides thereof; mechanical cleaning means supported by a shaft and disposed in said pulp chamber close to the screen face of the screen for removing a thickened mat of pulp therefrom by rotating the cleaning means by means of said shaft; and a filtrate outlet from said filtrate chamber, said apparatus further comprising a backflushing means mounted outside the vessel and including at least one cylinder having first and second end portions and a piston mounted within said cylinder for reciprocal movement therein, said first end portion of the cylinder being in open communication with the interior volume of the apparatus, and said second end portion of the cylinder being in open communication with the filtrate chamber, and said backflushing means comprising a power transmitting means for actuating the piston in the cylinder to move reciprocally in cycles each of said cycles comprising a slow stroke for drawing filtrate slowly into said cylinder and removing pulp slowly therefrom, and a fast stroke for expelling said drawn-in filtrate quickly out from said cylinder and drawing pulp quickly into the cylinder, said quickly expelled filtrate causing a backflush through said screen 2. An apparatus as recited in claim 1 wherein said first end portion of the cylinder is in open communication with the interior volume of the pulp inlet.

3. An apparatus as recited in claim 2 wherein said first end portion of the cylinder is connected directly to a conduit or closure defining the inlet at the end of the vessel.

4. An apparatus as recited in claim 1 wherein the filtrate outlet from the filtrate chamber is provided with a flow-controlled valve.

5. An apparatus as recited in claim 1 wherein at least two throttled branches are connected to said filtrate chamber and spaced from each other for distribution of the filtrate from said cylinder during said fast stroke to circumferentially different interior volumes of the filter chamber.

6. An apparatus as recited in claim 1 wherein it comprises a plurality of stationary cylindrical concentric screens rigidly connected to the top surface of a hollow support element, said screens defining a plurality of filtrate chambers and at least two concentric pulp chambers, said support element being provided with inlet gaps for distribution of pulp to be dewatered into the pulp chambers as well as an outlet channel system for discharging filtrate from said filtrate chambers to the filtrate outlet, said backflushing cylinder being connected to said outlet channel system.

7. An apparatus as recited in claim 1 wherein an adjustable mechanical device is mounted in the outlet for creating an increased pressure in the apparatus.

8. An apparatus as recited in claim 1 wherein it is in the form of a thickener for dewatering a pulp suspension of a low consistency of about 0,5 to 5% to obtain a thickened pulp suspension of a consistency in the range of about 5 to 30% or higher, based on dry fiber.

9. An apparatus as recited in claim 1 wherein it is in the form of a thickener for dewatering a pulp suspension of a consistency of about 8 to 10% to obtain a thickened pulp suspension of a consistency in the range of about 13 to 16%, based on dry fiber.

* * * * *